US006406412B1

(12) United States Patent
Chen

(10) Patent No.: US 6,406,412 B1
(45) Date of Patent: Jun. 18, 2002

(54) ABDOMEN EXERCISE DEVICE

(76) Inventor: Ming-Hui Chen, P.O. Box 90, Tainan City (TW)

( * ) Notice: Subject to any disclaimer, the term of this patent is extended or adjusted under 35 U.S.C. 154(b) by 0 days.

(21) Appl. No.: 09/871,635

(22) Filed: Jun. 4, 2001

(51) Int. Cl.[7] ..... A63B 26/00; A63B 71/00

(52) U.S. Cl. ..... 482/140; 482/91; 482/907; 482/908; 602/32

(58) Field of Search ..... 482/140, 91, 907, 482/908, 142; 5/607–618; 602/32

(56) References Cited

U.S. PATENT DOCUMENTS 4,546,967 A * 10/1985 Kecala ..... 272/93
4,746,114 A * 5/1988 Grider ..... 482/104
5,479,665 A * 1/1996 Cassidy et al. ..... 5/613
5,669,865 A * 9/1997 Gordon ..... 482/142
6,106,445 A * 8/2000 Lay ..... 482/142

* cited by examiner

*Primary Examiner*—Michael A. Brown
*Assistant Examiner*—Lori Baker Amerson

(57) ABSTRACT

An abdomen exercise device includes a bed body having a backrest and a seat pivotally connected with a joint to permit the backrest swing up and down to force the back of a user lying on the bed body bend the back up and down to exercise the user's abdomen. The backrest is swung up and down by a drive rod moved by a drive device consisting of a motor, a drive wheel, and a chain gear fixed with a lower end of the drive rod and a drive chain gear fixed eccentrically with the drive wheel rotated by the motor. With an endless chain extends around the drive chain gear and the chain gear to let two ends of the drive rod seesaw to swing up and down the backrest automatically.

4 Claims, 3 Drawing Sheets

ABDOMEN EXERCISE DEVICE

BACKGROUND OF THE INVENTION

1. Field of the Invention

This invention relates to an abdomen exercise device, particularly to one having a backrest moved to swing up and down by a drive device, forcibly swinging up and down an upper body of a person lying on the bed body as if the person make exercise to the abdomen continuously so as to reduce fat stored in the abdomen.

2. Description of the Prior Art

As civilization and various technologies have been developing, people work busily to have less time for taking exercise, and fast food has been increasing day by day as daily food for people so that not a few persons become overweight and fatty. The easiest part of a person to become fat is the waist, the abdomen. Although many kinds of fitness equipment are on market, such as a weight lifting, a stationary bike, a rower, a running machine, etc. But they are not suit to exercise an abdomen for reduce fat.

SUMMARY OF THE INVENTION

The objective of the invention is to offer an abdomen exercise device having a bed for a person to lie thereon to have an upper body of a user forcefully swung up forward and swing down backward to lie on the backrest again continually by the backrest of the bed body to reduce fat stored in the waist and the abdomen, avoiding improper exercise form possible causing exercise injury.

The feature of the invention is a bed consisting of a backrest and a seat, a slide groove provided in the bottom of the backrest, and a plurality of feet supporting the four corners of the bed body, at least a drive rod provided under the bed and having one end pivotally connected to a roller deposited in the slide groove, and the other end fixed with a chain gear, at least a shaft passing through the drive rod and fixed between two rear feet. The drive rod has the two ends possible to seesaw up and down alternately with the shaft functioning as a fulcrum. Further, a drive device is provided under the bed, having a motor, a drive wheel rotated by the motor, a drive chain gear eccentrically fixed on a side surface of the drive, and at least a transmitting chain gear fixed under the bed body, and an endless chain extending around the drive chain gear, the transmitting chain gear and the chain gear fixed with the lower end of the drive rod of a curved shape. Further at least a buffer is combined under the bed, consisting of a support tube and an extensible rod telescoping in the support tube, and the outer end of the extensible rod is pivotally connected to a proper location of the bottom of the backrest.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
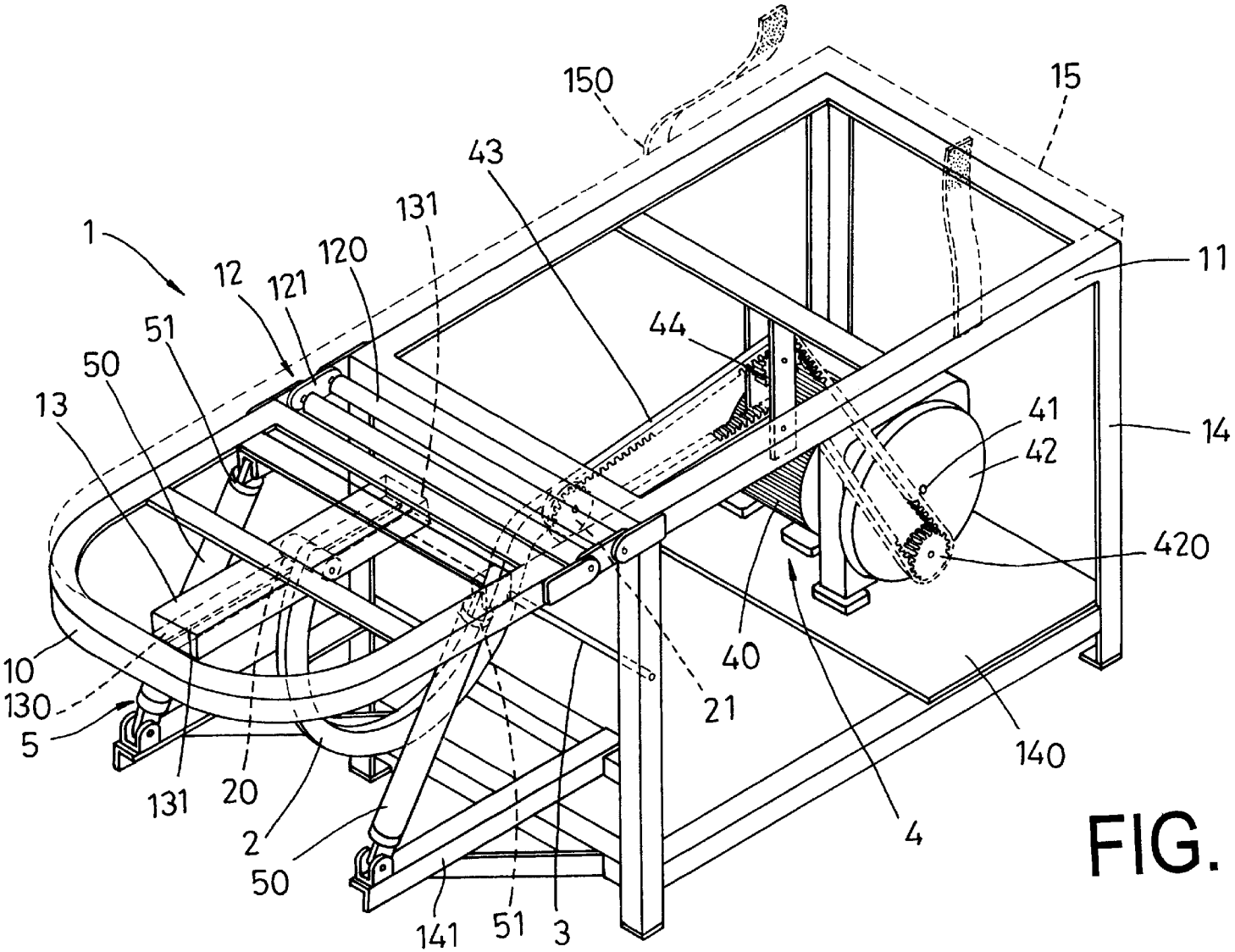
FIG. 1 is a perspective view of an abdomen exercise device in the present invention.

A preferred embodiment of an abdomen exercise device in the present invention, as shown in FIG. 1, includes a bed body 1 separated in a backrest 10 and a seat 11, a drive rod 2, a shaft 3, a drive device 4, at least one buffer 5 as main components combined together.

The backrest 10 and the seat 11 is pivotally connected with a joint 12 to enable the backrest 10 to swing up and down against the seat 10, and the joint 12 consists of a plurality of lateral rollers 120 and pivotal connecters 121 combined with two ends of the lateral rollers 120 and then fixed with both the backrest 10 and the seat 11 to permit the backrest 10 swing up with the lateral rollers as pivots. A slide groove 13 is provided lengthwise in the bottom of the backrest 10, and a lengthwise rail 130 is fixed in the slide groove 13, having a stop 131 at a front end and a rear end. The bed body 1 has a plurality of feet 14 supporting the bed body 1 to stand on the ground, and a flat plate 140 is provided below the seat 11 near the two front feet 14. Further, a plurality of lengthwise rods 141 is provided below the backrest 10 extending back from a lateral rod fixed between the two rear feet 14. A mattress 15 is laid on the bed body 1, and at least two fix bands 150 made of Velcro band are bound on two sides of the bed body to bind the feet of a user in place.

The drive rod 2 has a preset curved shape, having an upper end pivotally connected to a roller 20 laterally fixed in the slide groove 13 and possible to slide on the rail 130 back and forth. The drive rod 2 has another end fixed with a lower end of a chain gear 21.

The shaft 3 passes through laterally the drive rod 2, located between the rear feet 14 for the drive rod 2 to have two ends move up and down alternately in a seesawing way (or swinging up and down) with the shaft 3 as a fulcrum.

The drive device 4 is mounted on the flat plate 140, consisting of a motor 40 with a spindle 41 fixed with a drive wheel 42 on a front end of the spindle 41. A drive chain gear 420 is eccentrically fixed on a side surface of the drive wheel 42, and at last one transmitting chain gear 44 pivotally fixed vertically under the seat 11 for an endless chain 43 extending around the chain gear 21, the drive chain gear 420 and the transmitting gear 44.

The two buffers 5 are combined under the bed body 1, respectively consisting of a support tube 50 and an extensible rod 51 fitted and telescope in the support tube 50. The lower ends of each support tube 50 are fixed with an outer end of each lengthwise rod 141, and the outer ends of the extensible rods 51 are pivotally connected in parallel to the backrest 10 and symmetrically at two sides of the slide groove 13.

Figure 2:
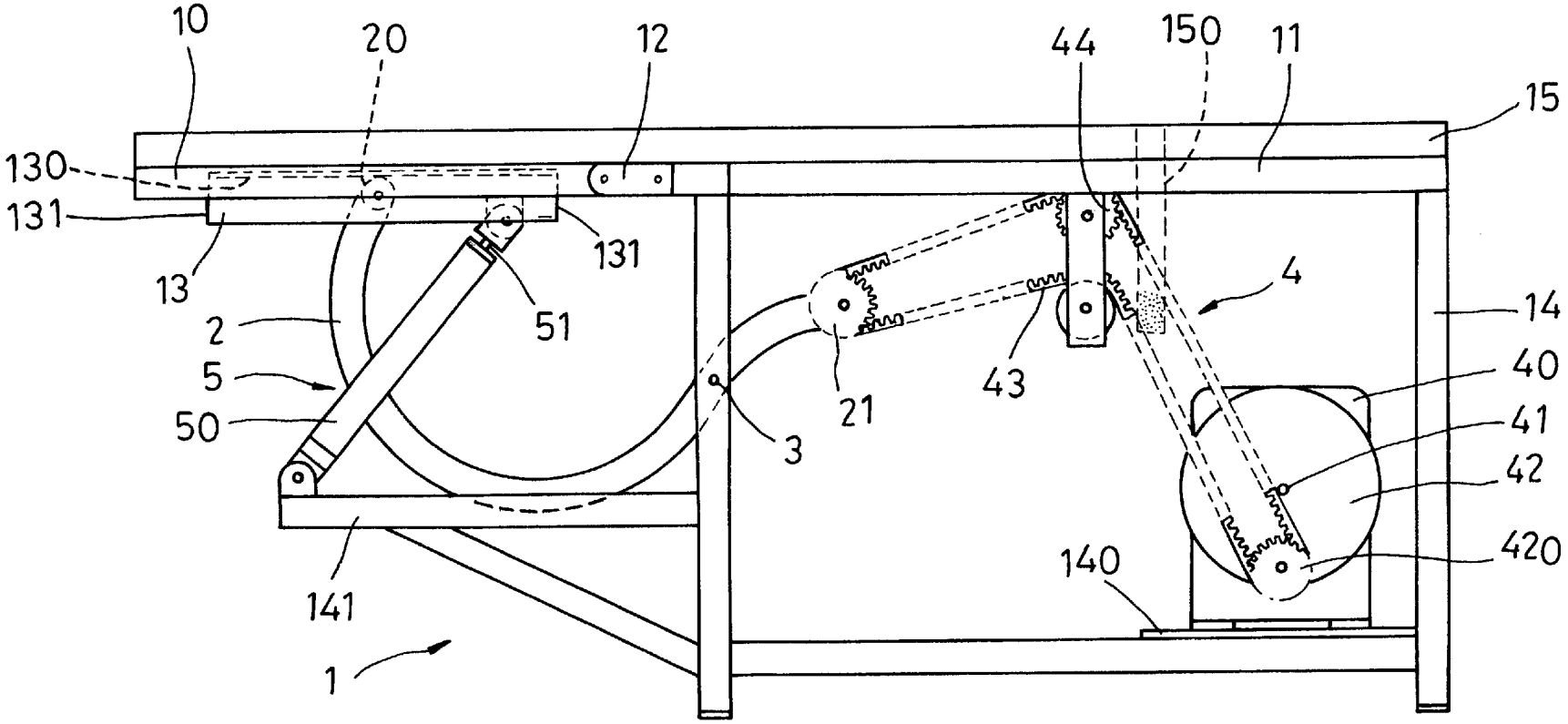
FIG. 2 is a side view of the abdomen exercise device in the present invention; and, FIG. 3 is a side view of the abdomen exercise device under using condition in the present invention.
Figure 3:
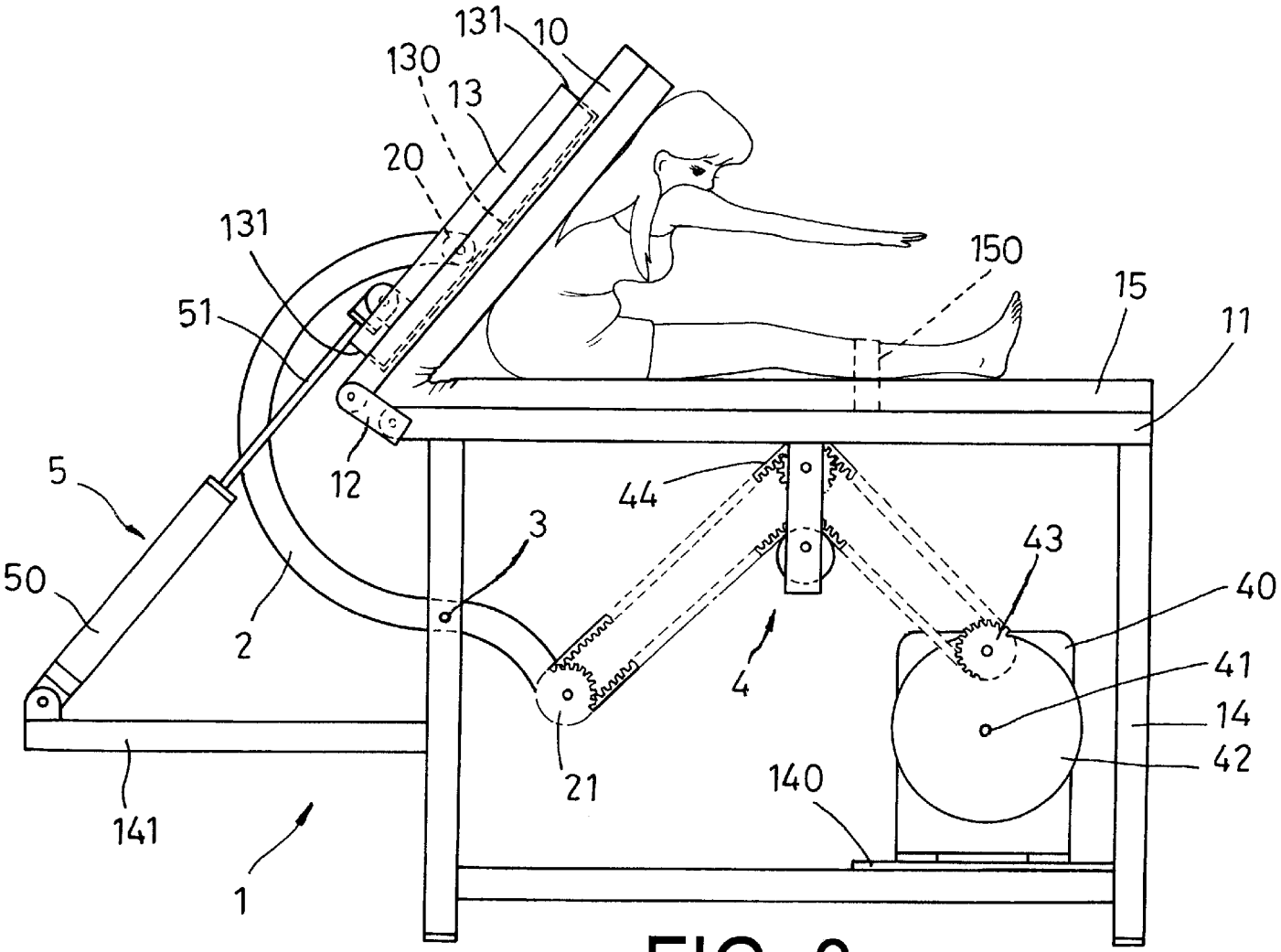

In using the abdomen exercise device after assembled together, referring to FIGS. 2 and 3, a user lies on the mattress 15 on the bed body 1, with the head and the back resting on the backrest 10 and two feet bound with the two bands 150 on the seat 11. Then the user starts the motor 40 of the drive device 40, and the spindle 41 rotates to drive the drive wheel 42. Next, the drive gear 420 moves the endless chain 43 and subsequently the transmitting wheel 44 and the chain gear 21 at the lower end of the drive rod 2, which is then moved to swing up and down with the shaft 3 as a fulcrum. Then the chain gear 21 is pulled up by the chain 43, and the drive rod 3 has its lower end moving up to let its upper end connected to the roller 20 swing down to pull the backrest 10 down to the flat condition. When the drive wheel 42 rotates to push the drive gear 420 upward, the chain 43 rotates the transmitting gear 44 and permits the chain gear 21 move down so that the drive rod 2 has its lower end moving down and its upper end swinging up to push the backrest 10 to bend forward, as shown in FIG. 3. As the drive wheel 42 continues to rotate and the drive gear 420 reaches the highest point, the backrest 10 swings and bends for the most forward point. After that the drive gear 420 moves down from the highest point to the lower point to repeat seesawing movement of the drive rod 2 and the backrest 10 swinging up and down continuously. Repetitive continual bending up and moving back to the flat condition of the backrest 10 forces the user to bend the upper body up and down continually so as to sit up, bend forward and lie down incessantly so that the user may reduce or completely remove the fat stored in the abdomen.

In addition, the two buffers 5 have respectively the extensible rod 51 pivotally connected to the backrest 10, so the extensible rod 51 moves with the backrest 10, pulled out in case of the backrest rising up and shrinking in the support tube 50 in case of the backrest swinging down. Therefore the two buffers 5 can gradually support the speed and the weight of the backrest 10 swinging down to the flat condition. Then a user can use the abdomen exercise device with safety and comfortableness.

While the preferred embodiment of the invention has been described above, it will be recognized and understood that various modifications may be made therein and the appended claims are intended to cover all such modifications that may fall within the spirit and scope of the invention.

What is claimed is:

1. An abdomen exercise device comprising:

a bed body consisting of a backrest and a seat pivotally connected to said backrest by means of a joint, said backrest having a slide groove formed in its bottom, said bed body supported by a plurality of feet under said bed body;

at least a drive rod of a curved shape fixed under said bed body, having an upper end pivotally connected to a roller deposited in said slide groove and an lower end fixed with a chain gear;

at least a shaft passing through said drive rod and located between two rear ones of said feet of said bed body, said shaft functioning as a fulcrum to enable two ends of said drive rod seesaw up and down alternately;

a drive device deposited below said bed body, consisting of a motor with a spindle, a drive wheel fixed on said spindle, a drive chain gear fixed eccentrically on an outer side surface of said drive wheel, a chain gear fixed with a lower end of said drive rod, at least one transmitting chain gear fixed under said bed body, an endless chain extending around said drive chain gear, said chain gear of said drive rod and said transmitting chain gear;

at least one buffer combined below said bed body, consisting of a support tube and an extensible rod fitted and telescoping in said support tube, an outer end of said extensible rod pivotally connected to a bottom surface of said backrest; and said chain gear of said drive rod moving up and down by said endless chain moved by said drive chain gear of said drive wheel rotated by said motor when said drive device is powered, said drive rod having an upper end pivotally connected to said roller in said slide groove, said roller pushing up or falling downs to move up or let down said backrest by swinging movement of said drive rod, a user just lying on bed body and having the user's back pushed to swing up and down continually on the backrest swung up and down continually by said drive rod force a user make exercise the abdomen, said buffer supporting and permitting said backrest to swing down gradually to protect said abdomen exercise device safely while in use.

2. The abdomen exercise device as claimed in claim 1, wherein said transmitting chain and said transmitting chain gear are made of leather.

3. The abdomen exercise device as claimed in claim 1, wherein said transmitting chain and said transmitting chain gear are made of steel.

4. The abdomen exercise device as claimed in claim 1, wherein said joint of connecting said backrest and said seat consists of a plurality of rollers pivotally supported by two pivotal members pivotally fixed on said backrest and said seat.

* * * * *